United States Patent [19]

Jeffrey

[11] Patent Number: 4,976,250

[45] Date of Patent: Dec. 11, 1990

[54] ADJUSTABLE COMPOUND BOW

[75] Inventor: Jennings L. Jeffrey, Coal City, W. Va.

[73] Assignee: J.L.J. Manufacturing, Inc., Crab Orchard, W. Va.

[21] Appl. No.: 279,071

[22] Filed: Dec. 2, 1988

[51] Int. Cl.[5] ..... F41B 5/12

[52] U.S. Cl. ..... 124/25; 124/25.6; 124/44.5; 124/88; 124/900

[58] Field of Search ..... 124/25, 24 R, 23 R, 124/86, 88, DIG. 1, 41 A, 89, 25.6, 44.5, 900

[56] References Cited

U.S. PATENT DOCUMENTS

| | | | |
|---|---|---|---|
| 2,714,377 | 8/1955 | Mulkey | 124/24 R |
| 3,182,651 | 5/1965 | Huntley | 124/24 R |
| 3,486,495 | 12/1969 | Allen | 124/DIG. 1 |
| 3,599,621 | 8/1971 | Scrobell | 124/88 X |
| 3,919,997 | 11/1975 | Day | 124/24 R X |
| 3,993,039 | 11/1976 | Groves et al. | 124/DIG. 1 X |
| 4,300,521 | 11/1981 | Schmitt . | |
| 4,337,749 | 7/1982 | Barna . | |
| 4,340,025 | 7/1982 | Caldwell . | |
| 4,343,286 | 8/1982 | Thacker | 124/41 A X |
| 4,457,287 | 7/1984 | Babington | 124/23 R |
| 4,478,203 | 10/1984 | Hayes | 124/DIG. 1 X |
| 4,512,326 | 4/1985 | Jarrett . | |
| 4,515,142 | 5/1985 | Nurney | 124/DIG. 1 X |
| 4,519,374 | 5/1985 | Miller | 124/DIG. 1 X |
| 4,646,708 | 3/1987 | Imes . | |
| 4,660,536 | 4/1987 | McPherson . | |
| 4,672,943 | 6/1987 | Bozek . | |
| 4,686,955 | 8/1987 | Larson | 124/23 R |
| 4,724,820 | 2/1988 | Chattin . | |
| 4,774,927 | 10/1988 | Larson | 124/23 R |
| 4,787,361 | 11/1988 | Vyprachticky | 124/88 |
| 4,836,177 | 6/1989 | Williams | 124/89 |
| 4,911,136 | 3/1990 | Brown | 124/25 X |

*Primary Examiner*—Peter M. Cuomo

*Attorney, Agent, or Firm*—Lowe, Price, LeBlanc, Becker & Shur

[57] ABSTRACT

A compound bow is disclosed that is fully adjustable for draw weight, draw length and let-off. The disclosed bow includes a frame assembly, a pair of bow limbs adjustably coupled at a first end thereof to the frame assembly to provide adjustment of the draw weight of the compound bow, an eccentric wheel coupled to a second end of each of the bow limbs, each eccentric wheel having a top cable travel groove and a bottom cable travel groove, wherein the bottom cable travel groove includes a let-off channel and a bow grip assembly coupled to the frame assembly. The frame assembly is mounted via a pivot pan assembly to draw length bar so that the draw length of the bow is fully adjustable.

17 Claims, 12 Drawing Sheets

HANDLE
42
20
40
54
56
52
50
46
48
44
60
41

TOP GROOVE WHEN PULLED

BOTTOM GROOVE WHEN PULLED

ADJUSTABLE COMPOUND BOW

BACKGROUND OF THE INVENTION

The present invention is related to compound bows. In particular, the present invention provides a compound bow that is fully adjustable in draw length, draw weight and the percentage of dropoff from the maximum draw weight of the bow to the force required to hold the bowstring in the fully drawn position.

Compound bow structures permit the storage of energy in the bow structure thereby reducing the amount of force needed to hold the bowstring in the fully drawn position. The percentage of drop-off in the maximum draw weight of the bow to the force required to hold the bowstring in the fully drawn position is sometimes referred to as "let-off" For example, the archer draws the bowstring back with a force of 80 lbs. until a breakpoint is reached, and the force required to hold the bowstring drops to 40 lbs. once the breakpoint is passed which would correspond to a 50% let-off. As will be readily appreciated, a substantial percentage of let-off improves the archer's performance, for example, by permitting the archer to hold the bow steady in competition while aiming at the target. A high percentage of let-off also permits the hunter to maintain the bow in a "cocked" ready state for long periods of time while waiting for his quarry.

Compound bow structures have been disclosed that provided let-off through the use of eccentric wheels or pulleys. For example, U.S. Pat. No. 4,660,536 issued to Mcpherson discloses a compound archery bow system that employs a eccentric cam wheel having an elliptical or heart shaped cam slot. Generally, however, it is necessary to change the wheels or pulleys in such systems if one wants to change the draw weight, draw length or let-off of the bow, thereby requiring substantial disassembly of the components of the bow.

Disassembly of the bow reduces the archer's ability to quickly and easily make adjustments during competition or while in the field Accordingly, it would be desirable to provide a compound bow system wherein the draw weight, draw length and let-off of the bow would be fully adjustable without requiring disassembly.

SUMMARY OF THE INVENTION

The present invention provides a compound bow that can be quickly and easily adjusted for draw length, draw force and let-off without requiring disassembly. Further, the overall design of the compound bow according to the present invention permits shooting from sitting and prone positions enabling the bow to be used by handicapped individuals. The bow is also fully adjustable to fit both left and right hand shooters.

More specifically, a compound bow having adjustable let-off according to the present invention includes: a frame assembly; a pair of bow limbs adjustably coupled at a first end thereof to the frame assembly to provide adjustment of the draw weight of the compound bow; an eccentric wheel coupled to a second end of each of the bow limbs, each eccentric wheel having a top cable travel groove and a bottom cable travel groove, wherein the bottom cable travel groove includes a let-off channel; and a bow grip assembly coupled to the frame assembly.

BRIEF DESCRIPTION OF THE DRAWINGS

With the above as background, reference should now be made to the following detailed description of the preferred embodiment and the drawings in which.

DETAILED DESCRIPTION OF THE PREFERRED EMBODIMENT

Figure 1:
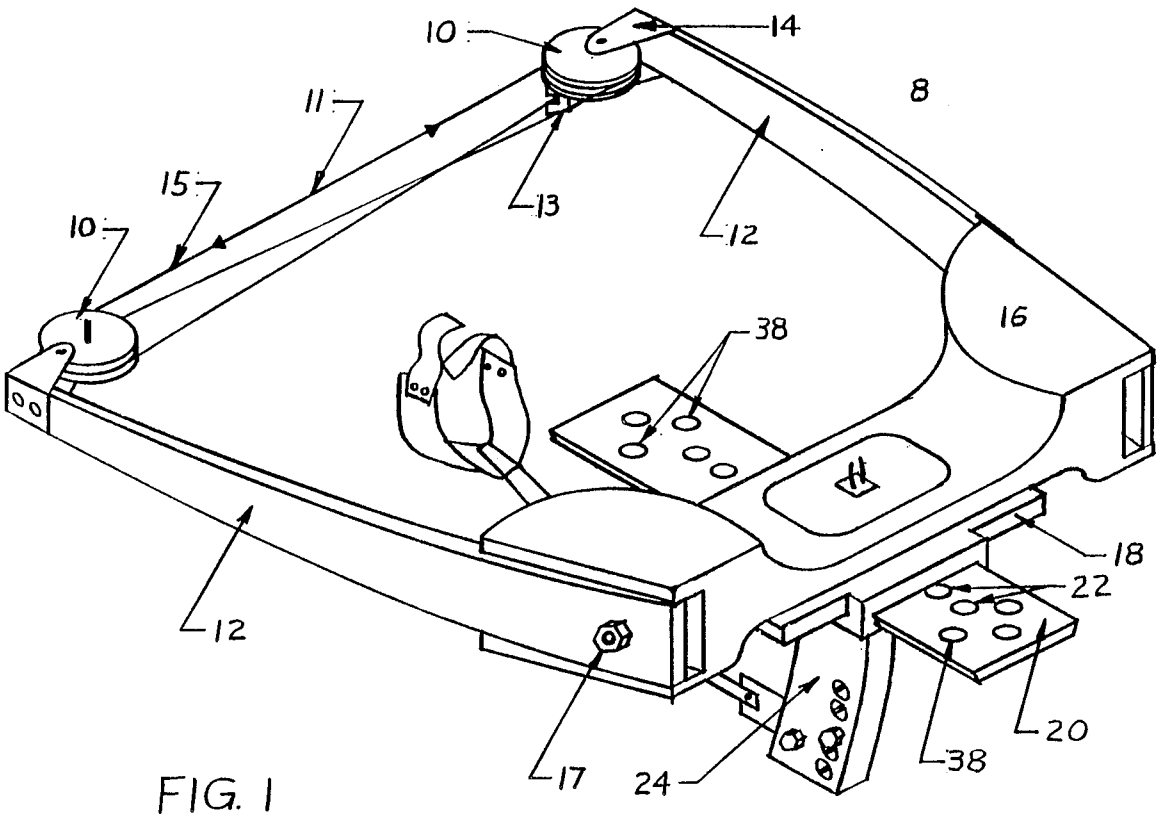
FIG. 1 is a perspective view of a compound bow according to the present invention.

Referring now to FIG. 1, a compound bow 8 according to the present invention is shown having eccentric wheels 10 mounted to bow limbs 12 via mounting brackets 14. Tuning blocks 13, which are also mounted to the mounting brackets 14, are provided beneath the eccentric wheels 10. A bow cable 15 is attached to the tuning blocks 13 and strung around the eccentric wheels 10 and attached to a bow string 11 in a manner which will be described in greater detail at a later point. The bow limbs 12 are coupled to a frame assembly 16 by poundage adjustment bolts 17 which enable the draw force of the compound bow 8 to be quickly and easily adjusted. The frame assembly 16 is connected to a pivot pan assembly 18 which in turn is mounted to a draw length bar 20 having a plurality of draw length adjustment holes 22. A bow grip assembly 24 is attached via a pivotal mounting (not shown) to the draw length bar 20. An arrow rest 26 is provided on the frame assembly 16 to prevent an arrow from falling out of the bow and to align the arrow with the nock of the bow cable 15.

The bow grip assembly 24 as illustrated in FIG. 1, is preferably mounted such that the compound bow 8 is maintained in a substantially horizontal plane in relation to the archer's body. Thus, the compound bow 8 is configured in a manner similar to a conventional crossbow. The preferred configuration permits easy line-of-sight target sighting and an overall compact design, which makes the compound bow 8 easier to carry in the field through underbrush and at the same time permitting handicapped individuals to easily shoot from a sitting position. Each of the structural components of the compound bow system 8 are shown in greater detail in the exploded view illustrated in FIG. 2.

Figure 2:
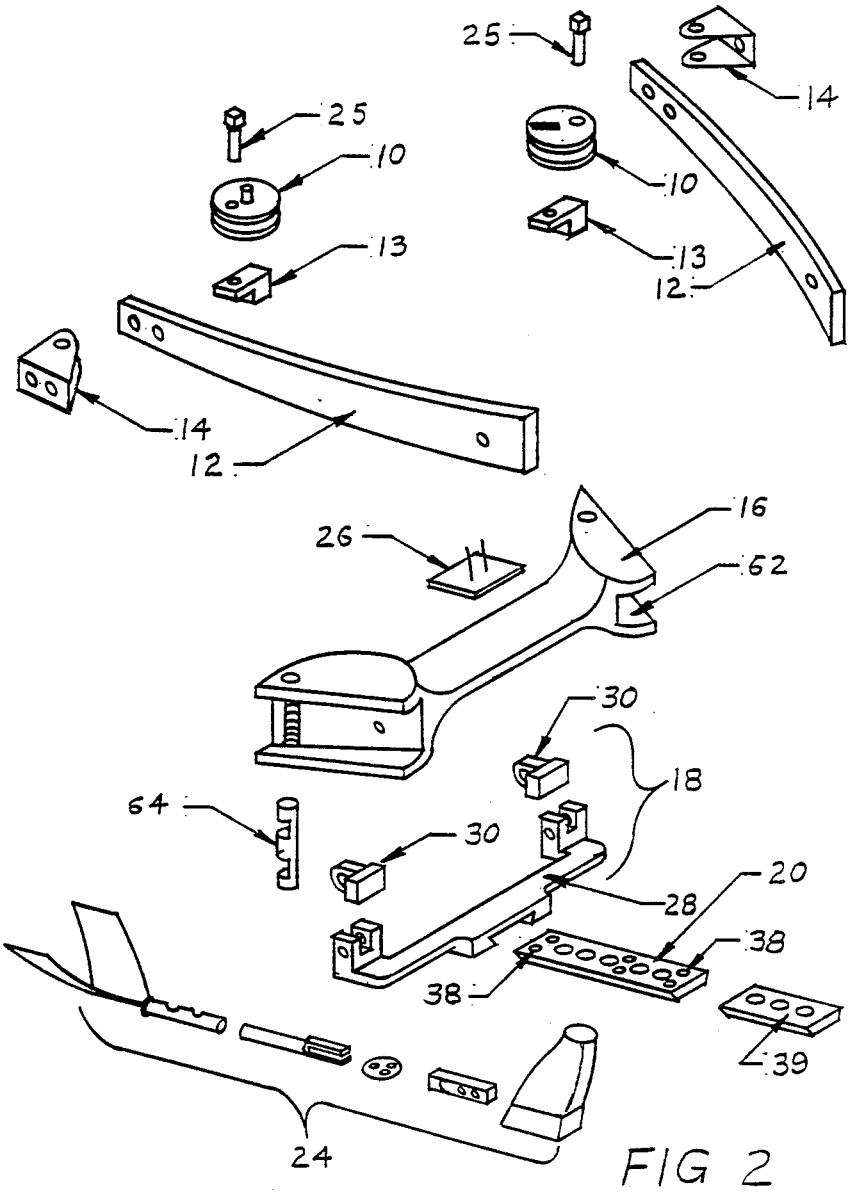
FIG. 2 is an exploded view of the compound bow illustrated in FIG. 1.
Figure 3A:
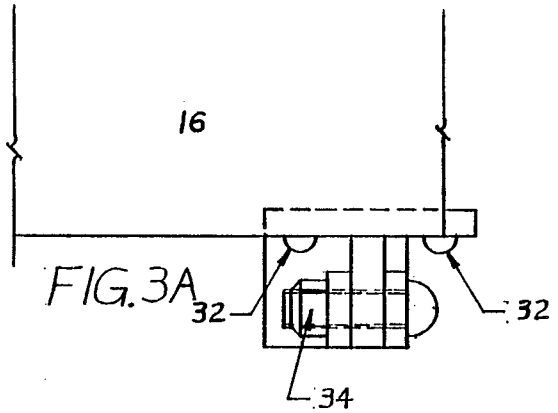
FIGS. 3*a*–3*c* are top, side and rear views of the connection of a pivot pan assembly to a frame assembly of the compound bow illustrated in FIG. 1.
Figure 3B:
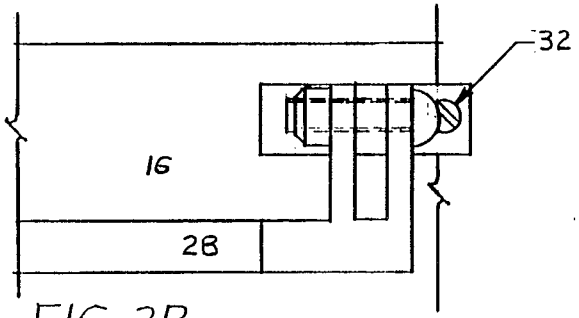
Figure 3C:
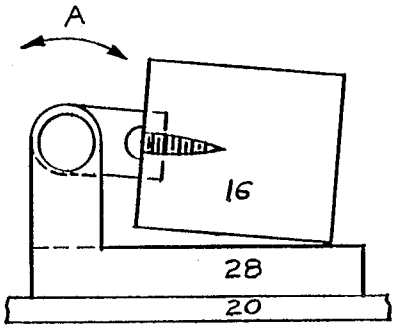

As shown in FIG. 2, the pivot pan assembly 18 includes a pan member 28 and two pivot mounting brackets 30 which are attached to the frame assembly 16 via mounting screws 32 and to the pan member via self-locking nut and bolt assemblies 34 as more clearly illustrated in FIG. *3a–3c*. The pivot pan assembly 18 permits the frame assembly 16 to be adjusted along Arc (A) as shown in FIG. *3c*. The adjustment provided by pivot pan assembly 18 overcomes one of the most common problems associated with a horizontal bow configuration, namely, that as the bow cable 15 is drawn back, the draw force has a tendency to pull the arm holding the bow upward. Thus, the archer must constantly fight the draw force in an attempt to maintain the horizontal position of the bow. The pivot pan assembly 18 permits the frame assembly 16 to be adjusted to tilt slightly downward, so that as the bow cable 15 is drawn back and the draw force causes the archer's arm to pull upward, the frame assembly 16 is effectively aligned in a horizontal position.

Figure 4:
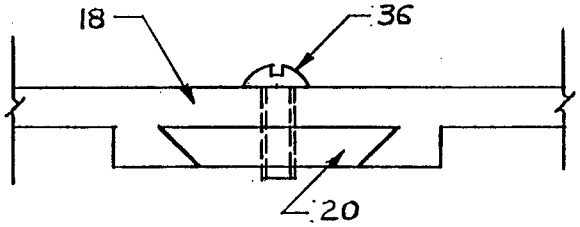
FIG. 4 illustrates the connection of the pivot pan assembly illustrated in FIG. 3*a*–3*c* to a draw length bar of the compound bow illustrated in FIG. 1.

The pivot pan assembly 18 is configured to slide back and forth over the draw length bar 20 (See FIG. 4), and is locked into place by a bolt 36 that screws into one of the draw length adjustment holes 22 formed in the draw length bar 20. The draw length adjustment holes 22 are preferably spaced at approximately half-inch intervals along the draw length bar 20, which is preferably of sufficient length to provide a draw length adjustment range of between about 22–37 inches. The draw length bar 20 also has extension bar mounting holes 38 located on its front and back edges (See FIG. 2), so that an extension draw length bar 39 can be added to either the front or back end of the draw length bar 20 to increase the draw range an additional 5 inches if desired.

As shown in greater detail in FIGS. *5a–5c*, the draw length bar 20 is attached to the bow grip assembly 24 by a pivotal mounting 40. The bow grip assembly includes a handle 42, a stabilizer arm assembly 44 and an arm cradle 46. The stabilizer arm assembly 44 includes a telescoping extension member 48 coupled to the arm cradle 46, an adjustment plate 50 coupled to the telescoping extension member 48 and a rod 52. The rod 52 is inserted in a slot 41 (FIG. *5c*) formed in the handle 42 and is held in place by a pivot pin 54 and a locking screw 56. Several adjustment holes 58 are provided in the handle 42 so that the rod 52 can be locked in several different positions. The arm cradle 46 includes a VELCRO holding strap 60 that wraps around and secures the archer's arm. The telescoping extension member 48 permits the overall length of the stabilizer arm assembly 44 to be adjusted, while the adjustment plate 50 permits adjustment of the lateral distance between the telescoping extension member 48 and the handle 42. Thus, the stabilizer arm assembly 44 can be easily adjusted to fit any right or left handed individual. The stabilizer arm assembly 44 helps to maintain the compound bow 8 in the proper position by relieving some of the force exerted on the user's wrist while holding the bow, and also helps to compensate to some extent for the pull-up experienced when the bow cable 15 is drawn as described above.

Figure 6:
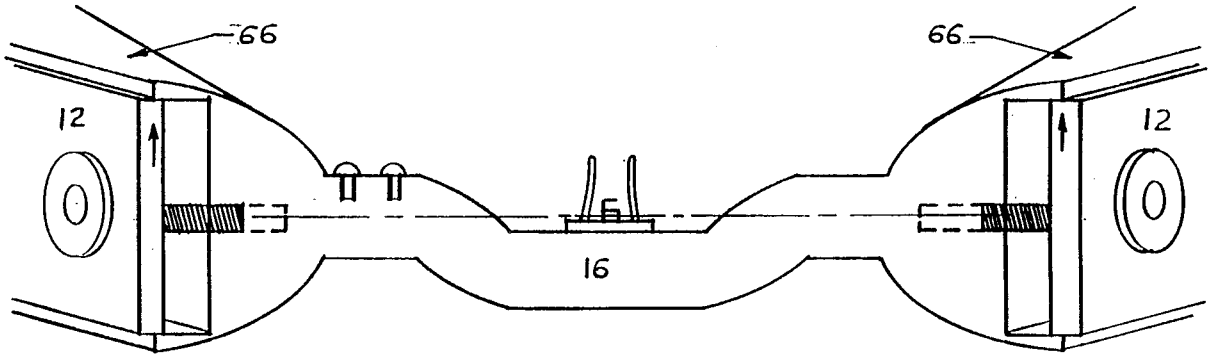
FIG. 6 is a front view of a frame assembly employed in the compound bow of FIG. 1 illustrating the connection of bow limbs via adjustable poundage bolts to the frame assembly.
Figures 5A, 5B, 5C:
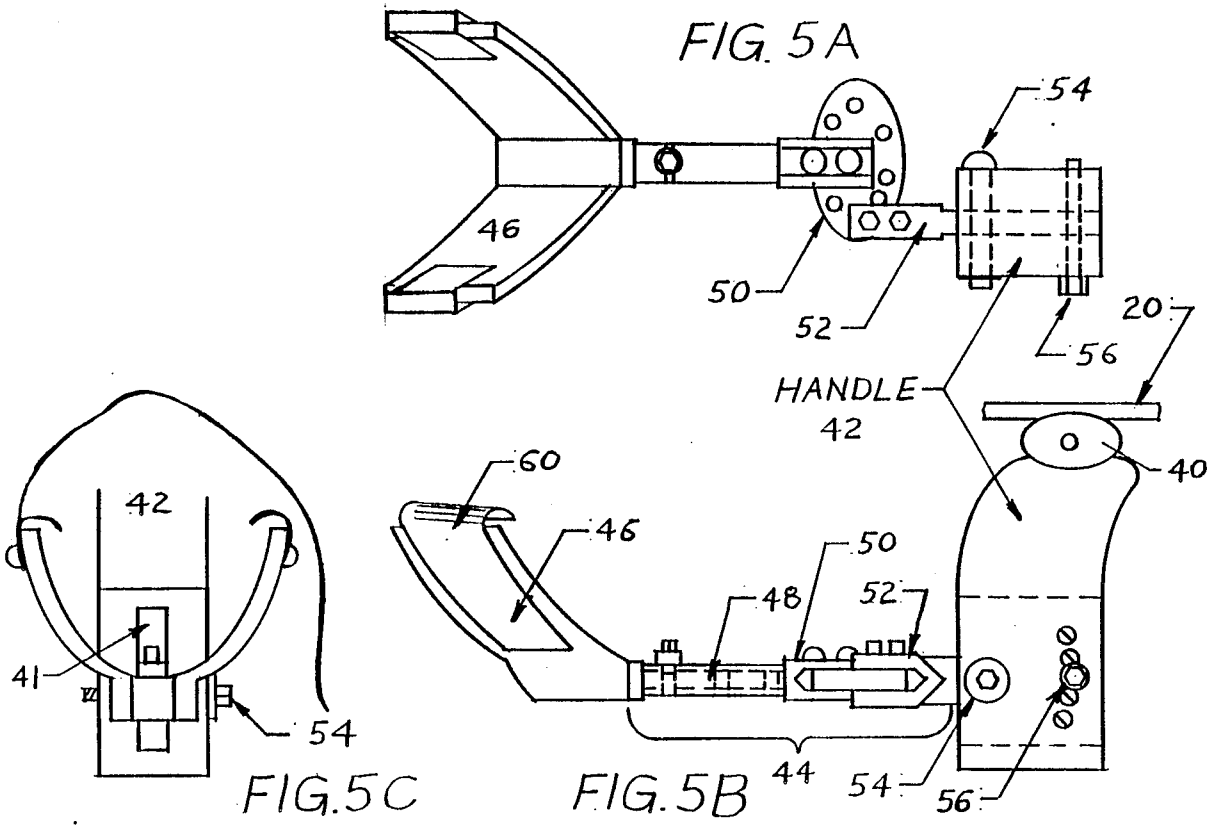
FIGS. 5*a*–5*c* are top, side and rear views of an bow grip assembly of the compound bow illustrated in FIG. 1.

As previously mentioned, the bow limbs 12 are attached to the frame assembly 16 with adjustable poundage bolts 17 that screw into the frame assembly 16. As more clearly illustrated in FIG. 2, the bow limbs 12 fit into a channel 62 provided in the frame assembly 16, and rest against a flex pin 64 provided at the rear portion of the channel 62 when under tension. Poundage markings 66 are provided on the front surface of the frame assembly 16 (See FIG. 6) to enable the user to accurately adjust each of the bow limbs 12 to the proper tension.

The bow limbs 12 are preferably constructed of wood laminates, fiberglass or any other suitable flexible material, and are slightly curved as compared with conventional bow limbs when under stress, for example, 10% of the total flex capability of the bow limbs 12 as compared with 30% in conventional bows when under the same pull weight. Preferrably, the bow limbs 12 are tapered both in thickness and width, for example, from approximately a width of $1\frac{7}{8}$ inches to 1 inch and a thickness of $\frac{3}{4}$ to $\frac{1}{2}$ inch. and are approximately 16 to 17 inches in length. Variations in materials and dimensions, however, are of course possible based on intended use. The unique shape of the bow limbs 12 insures equal distribution of forces over substantially the full length of the limbs 12 when the bow cable 13 is drawn.

Figure 7B:
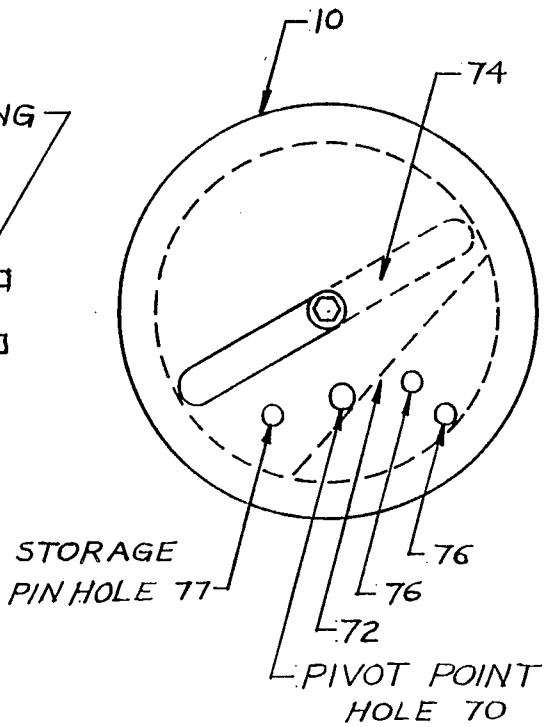
FIG. 7 illustrates an eccentric wheel employed in the compound bow illustrated in FIG. 1.
Figure 7A:
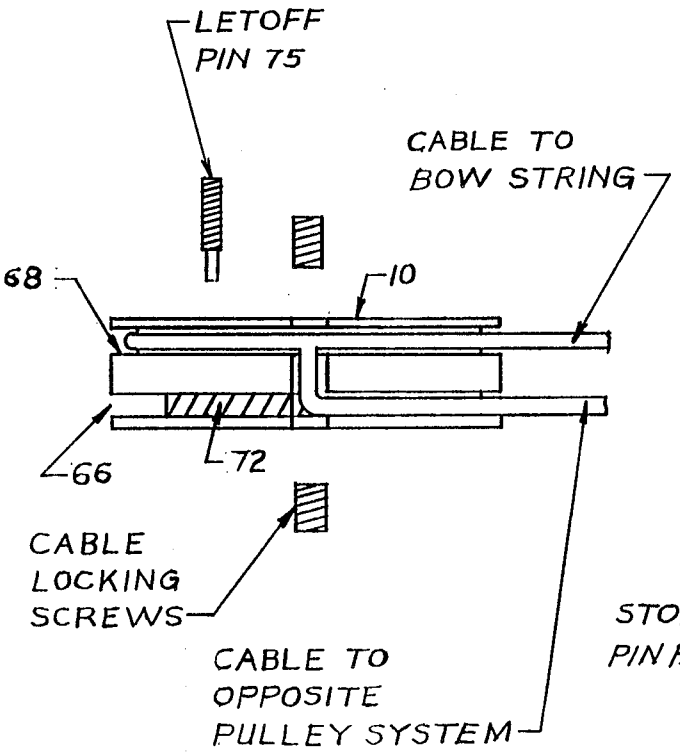

Referring now to FIG. 7, a detailed drawing of the eccentric wheels 10 is shown. Each wheel 10 has an bottom cable travel groove 66 and a top cable travel groove 68. The bottom and top cable travel grooves 66 and 68 are countersunk to a preferred depth of twice the diameter of the bow cable 15 or more to prevent the bow cable 15 from slipping off the wheels 10, for example, when the compound bow 8 is "dry fired" without an arrow. The wheels 10 are attached to the mounting brackets 14 (See FIG. 2) by pins 25 that pass through pivot point holes 70 formed in the wheels 10.

Figure 8B:
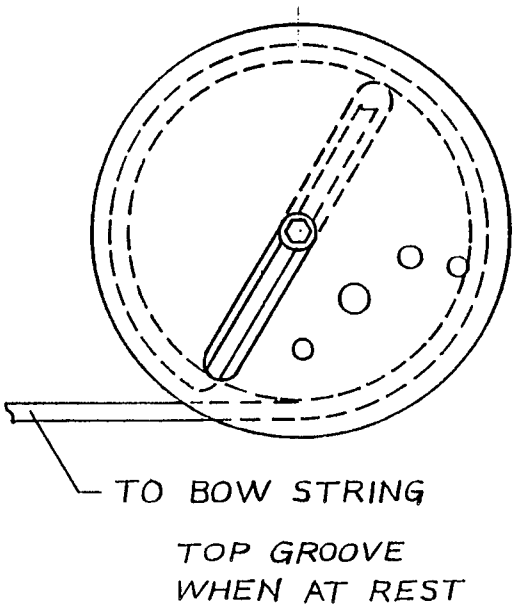
FIG. 8 illustrates the position of a bow cable wrapped around the eccentric wheel illustrated in FIG. 7 in a rest position.
Figure 8A:
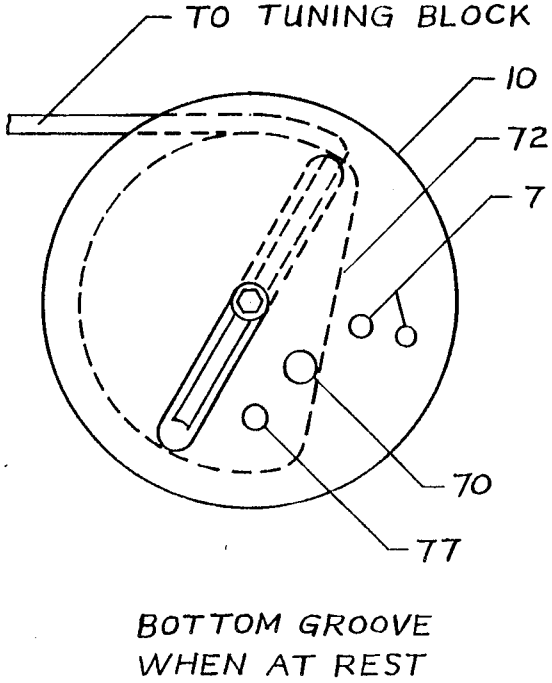
Figure 9B:
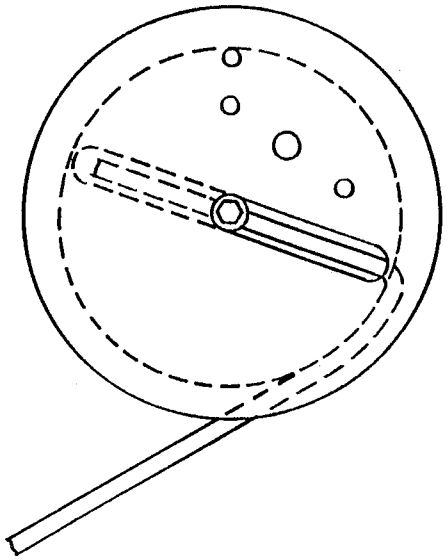
FIG. 9 illustrates the position of a bow cable wrapped around the eccentric wheel illustrated in FIG. 7 in a drawn position.
Figure 9A:
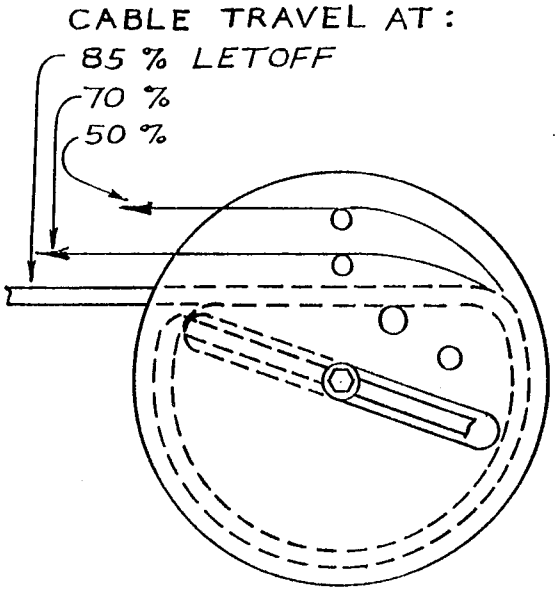

Let-off is controlled by a channel 72 formed in the bottom cable travel groove 66 (See FIG. 7). As illustrated in FIG. 8, the bow cable 15 (which is attached to the tuning block 13 opposite of the wheel 10 illustrated) passes over a small portion of the bottom cable travel groove 66, through a cable path 74 provided in the center of the wheel 10 and wraps around the top cable travel groove 68 in the rest position. As the bow cable 15 is drawn back, it falls into the channel 72 provided in the bottom cable travel guide 66 as shown in FIG. 9.

Figure 14:
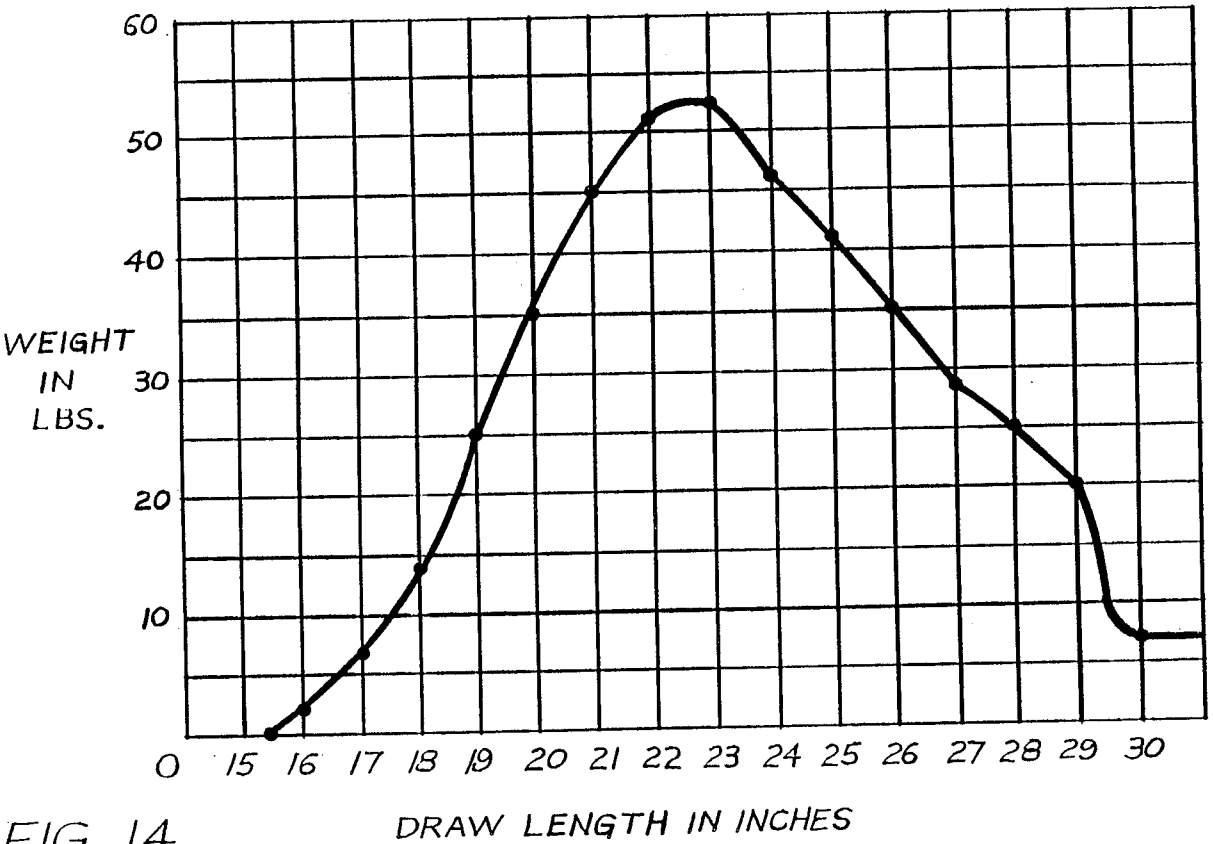
FIG. 14 is a graph illustrating the drop off obtained for the bow illustrated in FIG. 1.

Preferably, the channel 72 is cut to provide 85% let-off (although higher let-off values, i.e. up to about 95% are possible). Decreasing degrees of let-off, for example 70% and 50%, are provided by screwing a threaded let-off pin 75 into let-off holes 76 provided in the wheel 10, so that the bow cable rests on let-off pin 75 instead of falling completely into the channel 72. The let-off pin 75 is stored in a storage pin hole 77 when not in use. An example of the let-off force pattern for the 85% let-off channel 72 at 50 lbs. draw force is illustrated in FIG. 14.

Figure 10:
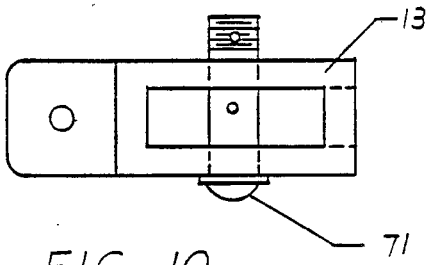
FIG. 10 illustrates a tuning block employed in the compound bow illustrated in FIG. 1.

The tuning blocks 13 insure that the bow cable 15 breaks or falls into the channel 72 of each of the eccentric wheels 10 simultaneous. The tuning blocks 13 have a rotatable pin 71 (See FIG. 10) that permits the user to draw in a portion of the bow cable 15, thereby adjusting the rest position of each of the eccentric wheels 10.

Thus, as described above, the draw weight, draw length and let-off of the compound bow 8 is fully adjustable without requiring that the bow be disassembled. In addition, adjustment for pull-up is provided by the pivot pan assembly 18 and the stabilizer arm assembly 44 can be easily adjusted to fit any sized left or right handed archer.

Figure 11A:
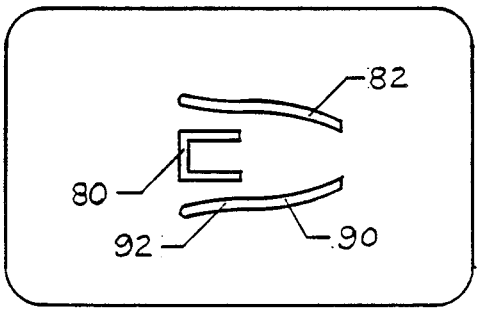
FIG. 11 is a top and side view of an arrow rest employed in the compound bow illustrated in FIG. 1.
Figure 11B:
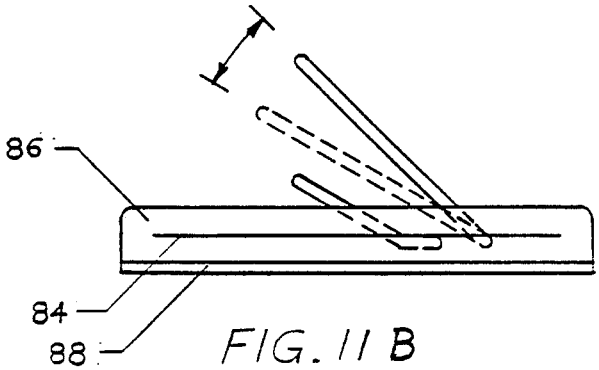

Another important feature of compound bow 8 is the construction of the arrow rest assembly 26. The arrow rest 26 assembly positively holds an arrow even if the compound bow 8 is completely turned over. Thus, the arrow does not have to be held in place by the user, which is especially helpful to hunters while moving through underbrush. As shown in FIG. 11, the arrow rest assembly 26 includes a shock absorbing arrow rest base, for example, a shock absorber spring 80 and a wire arrow clip 82 that are both inserted through a screen mesh 84 and molded into a flexible rubber pad 86. The screen mesh 84 insures that the shock absorber spring 80 and the wire arrow clip 82 will be retained in the proper position. An adhesive pad 88 is then attached to the wire mesh so that the arrow rest 26 can be attached to the frame assembly 16. The wire arrow clip 82 is shaped so that an arrow is retained within a lower portion 90 thereof and curved portions 92 partially close over the top of the arrow as illustrated in FIG. 11. The wire clip 82 is movable along an arc (B) illustrated in FIG. 11 providing for easy release of the arrow and complete clearance of the arrow vanes when the drawn bow string 11 is released.

Overall, the compound bow 8 provides many advantages over conventional compound bows. The unique U-shape allows the bow to sit horizontal as opposed to conventional vertical positions. This enables a user to shoot from a sitting or prone position as well as from a standing position. The hunter, therefore, can remain secluded while shooting instead of taking a chance at spooking his prey when he assumes the necessary standing position of conventional bows to release. Handicapped individuals can also shoot effectively from a wheelchair. The shooter's field of vision is unobstructed by the absence of an upright bow limb. Due to the shape of the bow, a shorter draw of the arrow is realized by the fact that the bow is in effect half-drawn in its resting position, i.e., half of the arrow length will fall between the position of the arrow rest 26 and the bow cable 15.

Figure 12:
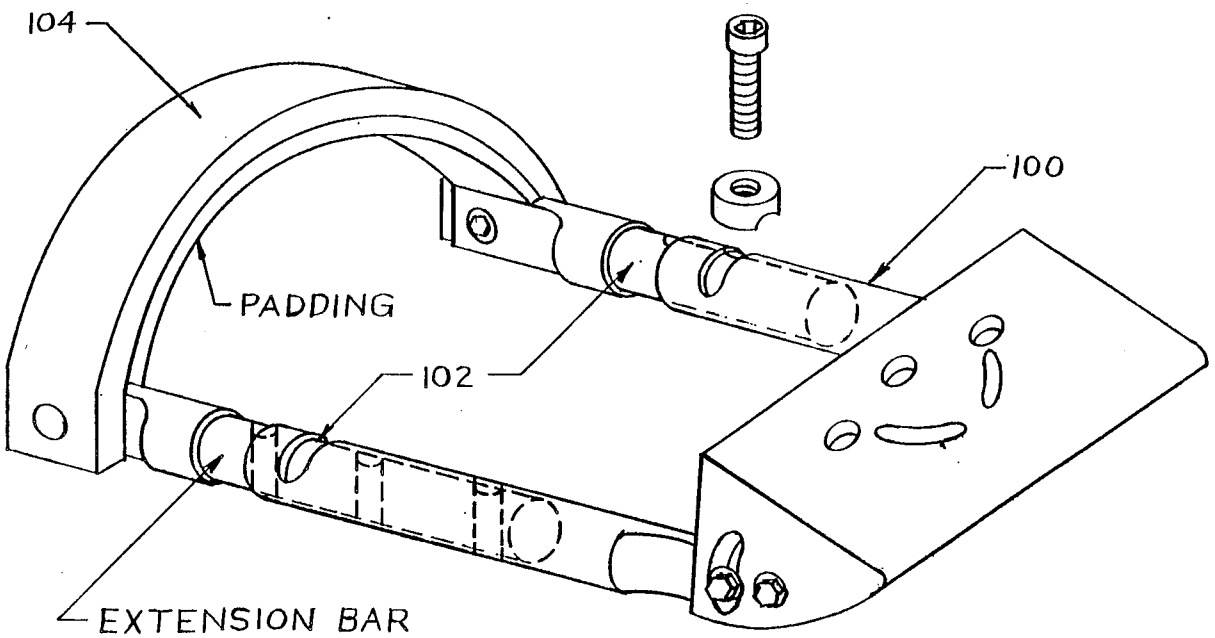
FIG. 12 illustrates a second type of arm stabilizer assembly that may be employed in the compound bow illustrated in FIG. 1.

The invention has been described with reference to certain preferred embodiments thereof, but it will be understood that modifications and variations within the spirit and scope of the claims are possible. For example, FIG. 12 illustrates a second embodiment of an arm stabilizer assembly 100 that also employs telescoping extension members 102 and a padded arm cup 104 that fits over the top of the arm instead under the arm as provided in the arm stabilizer assembly 44.

Figure 13A:
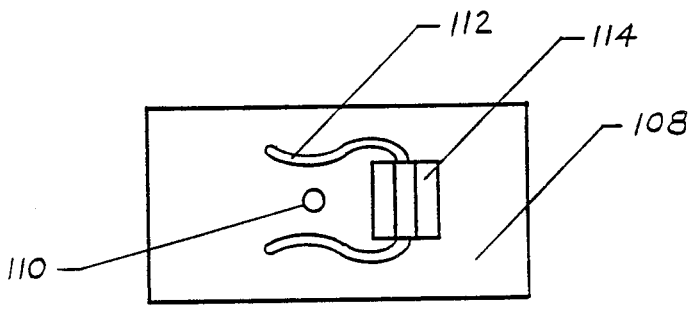
FIG. 13 illustrates a second type of arrow rest that may be employed in the compound bow illustrated in FIG. 1.
Figure 13B:
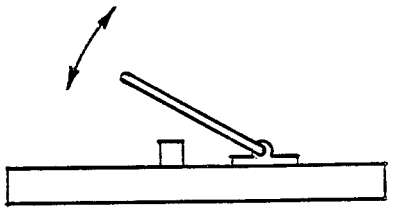

Variations in the structure of the arrow rest are also possible. The arrow rest 106 illustrated in FIG. 13 is constructed of base 108 having a modified BERGER button 110 and a wire arrow clip 112. In the embodiment shown in FIG. 13, the wire arrow clip 112 is retained by a plate 114. The base can have an adhesive coating or screws can be used to attach the arrow rest 106 to the frame assembly 16. Alternatively, the BERGER button 110 can be used in place of the shock absorber spring 80.

What is claimed is:

1. A compound bow comprising:

a. a frame assembly b. a pair of bow limbs adjustably coupled at a first end thereof to the frame assembly to provide adjustment of a draw weight of the compound bow;

c. a substantially circular eccentric wheel coupled to a second end of each of the bow limbs, each eccentric wheel having a top cable travel groove formed around an outer circumference of the eccentric wheel at a substantially uniform depth and a bottom cable travel groove including a first rounded portion and a let-off channel, wherein the first rounded portion of the bottom cable travel groove is formed around an inner circumference of the eccentric wheel between first and second points, and the let-off channel forms a substantially flat surface that extends from the first point to the second point along a line that is adjacent a pivot point hole formed in the eccentric wheel; and d. a bow grip assembly coupled to the frame assembly.

2. A compound bow as claimed in claim 1, further comprising a pivot pan assembly that couples the bow grip assembly to the frame assembly, wherein the pivot pan assembly permits the frame assembly to be adjusted along an arc with respect to the bow grip assembly.

3. A compound bow as claimed in claim 2, wherein said pivot pan assembly is adjustably coupled to a draw length bar that is attached to the bow grip assembly.

4. A compound bow as claimed in claim 1, wherein said bow grip assembly includes a handle and an arm stabilizer assembly adjustably coupled to the handle.

5. A compound bow as claimed in claim 4, wherein the arm stabilizer assembly includes a telescoping member attached to an arm cup.

6. A compound bow as claimed in claim 1, wherein each eccentric wheel includes at least one let-off hole positioned above the let-off channel formed in the bottom cable travel groove.

7. A compound bow as claimed in claim 6, further comprising a let-off pin configured to permit insertion into the let-off hole provided in each eccentric wheel

8. A compound bow as claimed in claim 1, further comprising tuning blocks coupled to the bow limbs, the tuning blocks being configured to receive a bow cable and provide adjustment of a rest position of the eccentric wheels when the bow cable is strung around the eccentric wheels.

9. A compound bow as claimed in claim 1, wherein the bow grip assembly is adapted to position the compound bow in a substantially horizontal plane to a user's body when the user is in a standing position.

10. A compound bow as claimed in claim 1, further comprising an arrow rest coupled to the frame assembly.

11. A compound bow as claimed in claim 10, wherein the arrow rest assembly includes a base member, an arrow rest base and an arrow clip provided on a top surface of the base member, wherein the arrow clip has a first portion in which the body of an arrow is substantially retained and second indented portions that prevent the arrow body from slipping out of the first portion.

12. A compound bow as claimed in claim 1, wherein the let-off channel provides about 85% or greater let-off.

13. An eccentric wheel for use on a compound bow comprising: a top cable travel groove and a bottom cable travel groove including a first rounded portion and a let-off channel, wherein the eccentric wheel is substantially circular, the top cable travel groove is formed around an outer circumference of the eccentric wheel at a substantially uniform depth, the first rounded portion of the bottom cable travel groove is formed at a uniform depth from a first point to a second point around ann inner circumference of the eccentric wheel, and the let-off channel forms a substantially flat surface that extends from the first point to the second point along a line that is adjacent a pivot point hole formed in the eccentric wheel.

14. An eccentric wheel as claimed in claim 13, further comprising at least one let-off hole positioned above the let-off channel formed in the bottom cable travel groove.

15. An eccentric wheel as claimed in claim 14, further comprising a let-off pin configured to fit into the let-off hole.

16. An eccentric wheel as claimed in claim 13, wherein the top cable travel groove and the bottom cable travel groove between the first and second points are countersunk to a depth of about twice the diameter of a bowstring to be strung around the eccentric wheel.

17. An eccentric wheel as claimed in claim 13, wherein the let-off channel provides about 85% or greater let-off.

* * * * *